US009812775B2

(12) United States Patent
Zahavi et al.

(10) Patent No.: US 9,812,775 B2
(45) Date of Patent: Nov. 7, 2017

(54) LARGE APERTURE ANTENNA WITH NARROW ANGLE FAST BEAM STEERING

(75) Inventors: Dov Zahavi, Haifa (IL); Shaul Baruch Laufer, Petah-Tiqwa (IL)

(73) Assignee: Elbit Systems Ltd., Haifa (IL)

( * ) Notice: Subject to any disclaimer, the term of this patent is extended or adjusted under 35 U.S.C. 154(b) by 0 days.

(21) Appl. No.: 14/000,653

(22) PCT Filed: Feb. 23, 2012

(86) PCT No.: PCT/IB2012/050826
§ 371 (c)(1),
(2), (4) Date: Aug. 21, 2013

(87) PCT Pub. No.: WO2012/114296
PCT Pub. Date: Aug. 30, 2012

(65) Prior Publication Data

US 2013/0321204 A1 Dec. 5, 2013

(30) Foreign Application Priority Data

Feb. 23, 2011 (IL) ..... 211386

(51) Int. Cl.
*H01Q 3/08* (2006.01)
*H01Q 3/20* (2006.01)
*H01Q 3/26* (2006.01)

(52) U.S. Cl.
CPC ..... *H01Q 3/08* (2013.01); *H01Q 3/20* (2013.01); *H01Q 3/26* (2013.01)

(58) Field of Classification Search
CPC .. H01Q 3/12; H01Q 3/08; H01Q 3/20; H01Q 3/26

(Continued)

(56) References Cited

U.S. PATENT DOCUMENTS 3,840,821 A * 10/1974 Conway ..... 331/14
4,039,246 A * 8/1977 Voigt ..... F41G 7/2213 244/3.16

(Continued)

FOREIGN PATENT DOCUMENTS

| | | |
|---|---|---|
| BE | 826595 | 6/1975 |
| EP | 1601047 | 11/2005 |
| WO | WO 99/22422 | 5/1999 |

OTHER PUBLICATIONS

Soon Ik Jeon et al.: "Active phased array antenna for mobile multimedia services via satellite", Areospace Conference Proceedings, 2000, IEEE Mar. 18-25, 2000 (Mar. 18, 2000), vol. 5, No. 18, pp. 165-170, XP010517164, ISBN: 978-0-7803-5846-1.

(Continued)

*Primary Examiner* — Frank J McGue
(74) *Attorney, Agent, or Firm* — Pearl Cohen Zedek Latzer Baratz LLP

(57) ABSTRACT

A system for rapidly steering a directive beam in an antenna is provided herein. The system includes: an antenna configured to produce a directive beam; means for steering the beam rapidly, along small angles; and means for steering the beam slowly, along large angles. According to one embodiment, the antenna is implemented as a phased array antenna, wherein the means for steering the beam rapidly, along small angles, is implemented as a phased array control, and wherein the means for steering the beam slowly, along large angles, is a mechanical mechanism implemented using gimbals. According to another embodiment, the antenna includes a main reflector and a sub reflector, and wherein the means for steering the beam rapidly, along small angles, mechanically controls the sub reflector, and wherein the means for steering the beam slowly, along large angles, mechanically controls the main reflector.

4 Claims, 5 Drawing Sheets

(58) Field of Classification Search
USPC ..... 342/359
See application file for complete search history.

(56) References Cited

U.S. PATENT DOCUMENTS

| | | | | |
|---|---|---|---|---|
| 5,351,060 | A * | 9/1994 | Bayne | 343/766 |
| 6,043,788 | A * | 3/2000 | Seavey | H01Q 3/20 343/765 |
| 6,078,296 | A * | 6/2000 | Wetter, Jr. | 343/766 |
| 6,943,750 | B2 * | 9/2005 | Brooker et al. | 343/839 |
| 2006/0017638 | A1 * | 1/2006 | Guidon | H01Q 21/005 343/757 |
| 2008/0018545 | A1 * | 1/2008 | Kaplan et al. | 343/713 |

OTHER PUBLICATIONS

International Search Report for PCT International Patent Application No. PCT/IB2012/050826, dated Jul. 19, 2012.

* cited by examiner

LARGE APERTURE ANTENNA WITH NARROW ANGLE FAST BEAM STEERING

CROSS-REFERENCE TO RELATED APPLICATIONS

This application is a National Phase Application of PCT International Application No. PCT/IB2012/050826, International Filing Date Feb. 23, 2012, claiming priority of Israel Patent Application No. 211386, flied Feb. 23, 2011, which are hereby incorporated by reference.

BACKGROUND

1. Technical Field

The present invention relates to the field of antennas, and more particularly, to systems for rapidly steering antennas having directive beams.

2. Discussion of Related Art

Two main technologies are known in the art for implementing a telecommunication antenna (such as Satellite Communication—SATCOM) on a mobile platform (such as an Unmanned Arial Vehicles—UAVs). Such an antenna needs to address both short and fast movements as well as long and relatively slow movements.

One known technology is a mechanically steered antenna. An antenna (e.g.—a parabolic dish) is mounted on a motorized 3 axis gimbals. The motors are controlled to implement the fast and slow movements of the dish.

Another technology is phased array in which the antenna comprises of a large number of small—i.e.—Omni directional—radiating elements, the phase and sometime amplitude of the signals of each element is controlled so that the signals going through all the elements combine in space to create a beam pointing in the desired direction.

Fast beam movements of a mechanically steered antenna, even if the motions are small, requires large mechanical moments which means sturdy motors and mechanics, large currents and high power electronics.

Phased arrays do not require all of these but have other drawbacks—their directivity is severely degraded when the beam is steered far away from the bore sight of the array and implementing a large aperture antenna requires a very large number of radiating elements and the associated electronics becomes very complex, expensive, power consuming and hot.

BRIEF SUMMARY

The present invention, in embodiments thereof, provides a system for rapidly steering a directive beam in an antenna. The system includes: an antenna configured to produce a directive beam; means for steering the beam rapidly, along small angles; and means for steering the beam slowly, along large angles. According to one embodiment, the antenna is implemented as a phased array antenna, wherein the means for steering the beam rapidly, along small angles, is implemented as a phased array control, and wherein the means for steering the beam slowly, along large angles, is a mechanical mechanism implemented using gimbals. According to another embodiment, the antenna includes a main reflector and a sub reflector, and wherein the means for steering the beam rapidly, along small angles, mechanically controls the sub reflector, and wherein the means for steering the beam slowly, along large angles, mechanically controls the main reflector.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

The present invention will be more readily understood from the detailed description of embodiments thereof made in conjunction with the accompanying drawings of which.

DETAILED DESCRIPTION

Figure 1:
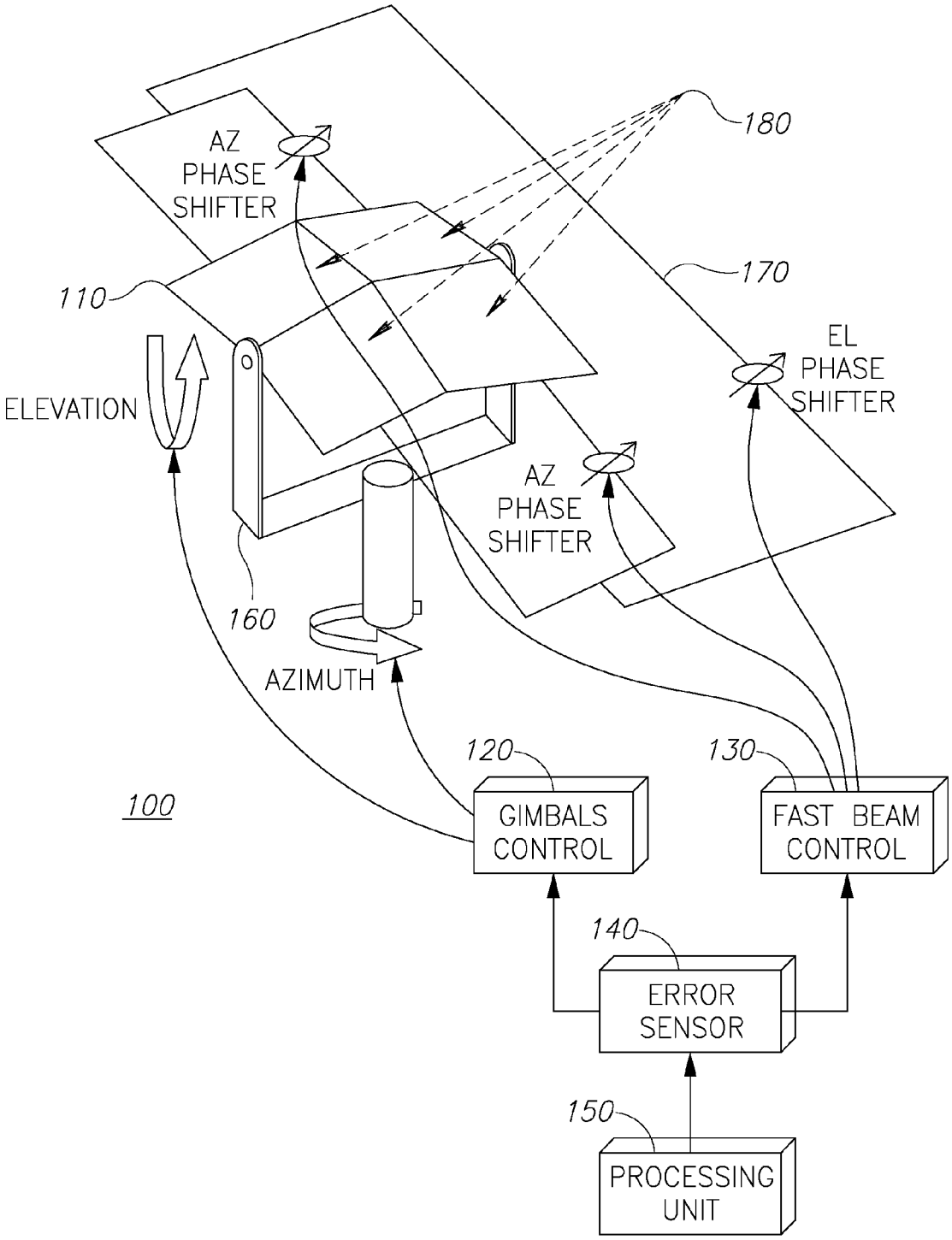
FIG. 1 is a high level schematic illustration of a system, according to one embodiment of the invention.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Embodiments of the present invention provide a system for steering an antenna both in short-fast movements and in long-slow movements, possibly but not exclusively, implemented as an antenna of a mobile SATCOM terminal. The dimensions of this antenna are determined by the SATCOM link budget and by SATCOM regulations. For example, to provide reasonable data rates and conform to these regulations, the antenna would have an aperture of 60 cm and this would form a beam of about 2.5°.

When installed aboard a mobile platform, land vehicle, aircraft or boat, the antenna must be able to rotate 360° in Azimuth, cover most of the Elevations between 0° to 90°, and control polarization between 90° and −90°.

Such an antenna need to be equipped with a pointing method to ensure that the beam is pointing at the right satellite, either by performing some tracking method or by using navigation sensors (e.g.—INS) to point the antenna at the satellite.

The antenna also needs to be equipped with a stabilization capability to compensate for any perturbations caused by vehicle vibrations and shocks.

Both beam tracking and stabilization involve fast motions of a high directivity beam.

As described above, what is required is the ability to perform fast, narrow angle (e.g. a few degrees) steering for a high directivity beam.

This should be done in an arbitrary, rather than a fixed pattern (such as in Conical Scanning) to compensate for random perturbations or implement antenna tracking.

FIG. 1 is a high level schematic illustration of a system, according to one embodiment of the invention. System 100 combines the advantages of mechanical antennas—namely the simplicity of achieving high gain and large angular range—with the fast beam steering capability of phased array.

System 100 includes a phased array antenna 110 having a small number of directional elements. The minimum is 1×2 array that will enable a single plane ray steering and 2×2 array for two planes (that may but do not have to be orthogonal) steering. This array is mounted on a set of gimbals 160 designed to perform slow, large angular motions. The beam is the sum of the beams 180 of the separate elements so that the sum directivity is defined by the combined antenna aperture of all the elements.

The phased array electronics controls the fast, narrow beam steering. The mechanical gimbals 160, because they perform slow motions, require only low mechanical moments and can be of relatively light construction. Polarization control is also in use but not shown for the sake of simplicity.

The 4 elements point at slightly divergent directions (In azimuth and elevation). The 4 elements are fed by a network of splitter where 2 phase shifters control the phase so that the azimuth of the combined beam is shifted. An additional phase shifter controls the elevation shift between the upper and lower rows. The shifters are controlled by a fast beam control 130 which receive the control signals after processing the fast corrections by error sensors unit 140. A set of gimbals implements the slow, large, motions of the array. The gimbals are controlled by the slow steering gimbals control 120. A processing unit 150 may divert and control the operation of either the gimbals or the phased array steering mechanism, based on the required steering movement (long-slow or short-fast) at any given point of time.

A more generalized description of the system 100 may include a system for steering an antenna. The system includes: an antenna configured to produce a directive beam; a first actuator configured to steer the directive beam over a first angle over a first period of time; and a second actuator configured to steer the directive beam over a second angle over a second period of time, wherein the first angle is substantially larger than the second angle, and wherein the first period of time is substantially longer than the second period of time.

Consistent with some embodiments of the invention, the antenna is implemented as a set of one or more phased array antennas, wherein the first actuator is a phased array control unit configured to steer the directive beam of the set of the one or more phased array antennas, and wherein the second actuator is a mechanical actuator configured to mechanically steer the set of the one or more phased array antennas in its entirety.

Consistent with some embodiments of the invention, the antenna comprises a primary reflector and a secondary reflector facing the primary reflector, and wherein the first actuator is a mechanical actuator coupled to the secondary reflector and configured to mechanically steer the secondary reflector, and wherein the second actuator is a mechanical actuator coupled to the primary reflector and configured to mechanically steer the primary reflector.

Consistent with some embodiments of the invention, the mechanical actuator comprises a set of at least two gimbals. Consistent with some embodiments of the invention, wherein the set of one or more phased array antennas comprises 4 phased array antennas, each set in a different spatial angle.

Figure 2:
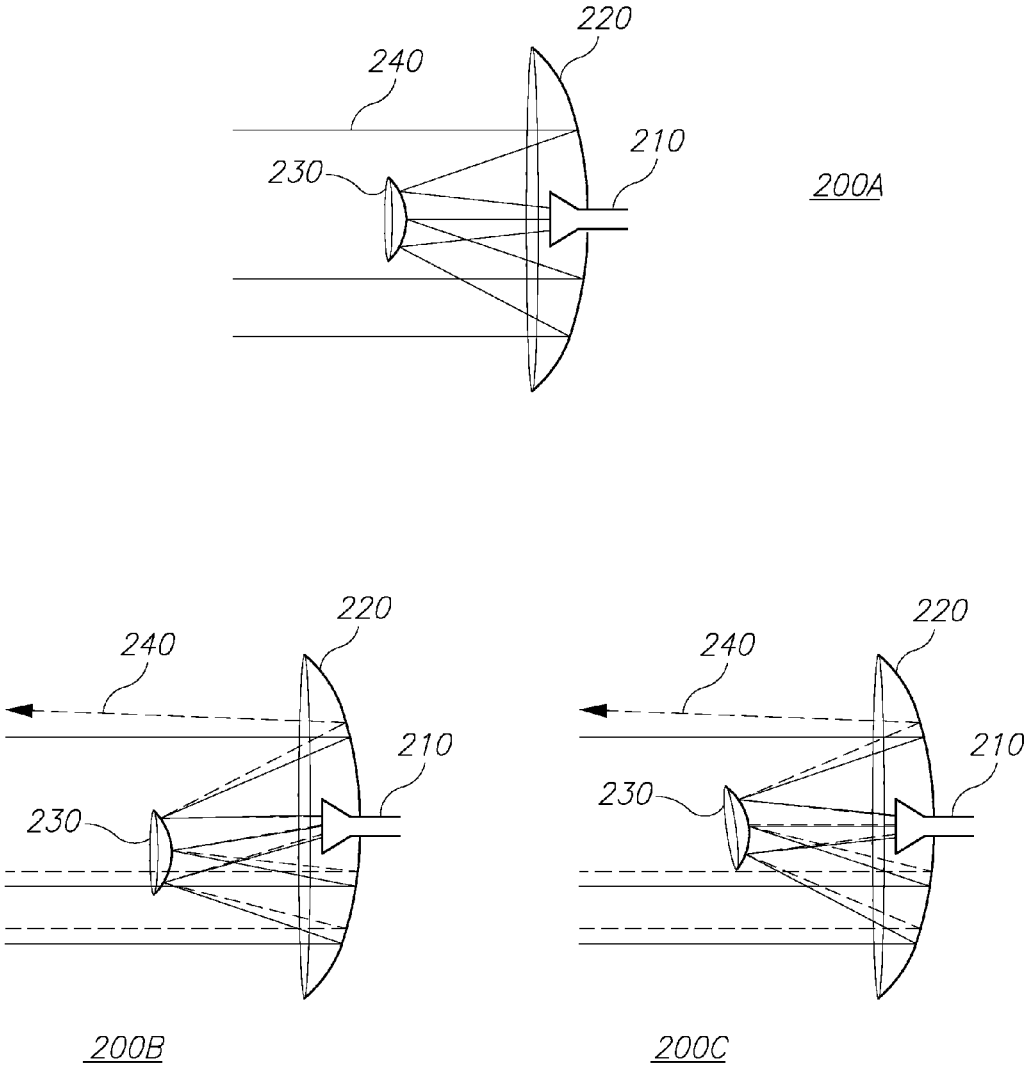
FIG. 2 shows schematic illustrations of a system, according to another embodiment of the invention.

FIG. 2 shows schematic illustrations of a system, according to another embodiment of the invention. The second embodiment is based on a feed 210, a primary reflector 220 and a secondary reflector 230 where the secondary reflector 230 may be either slightly rotated as shown in 200C or slightly shifted as shown in 200B. This causes small changes in the beam direction 240 (also some degradation in beam directivity). This antenna is mounted on a set of gimbals in a similar arrangement to the previous section.

Because the secondary reflector 230 is much smaller than the entire antenna, and because small motions of the sub-reflector are sufficient, a much lighter and low power (compared to those required to steer the entire main reflector) mechanical device is required to perform fast beam steering. Also these fast motions do not affect the signal transmissions to the feed and this improves reliability and transmission efficiency.

As shown in 200B and 200C shift and rotation, respectively cause small movements in the direction of the beam. Although only motion in one dimension is shown, it is understood that the arrangement is valid for both azimuth and elevation (polarization is best handled in the feed).

Consistent with some embodiments of the invention, primary reflector 220 is parabolic and secondary reflector 230 is hyperbolic.

Consistent with some embodiments of the invention, primary reflector 220 and secondary reflector 230 are set in a Cassegrain antenna configuration.

Consistent with some embodiments of the invention, the antenna is configured for telecommunication.

Consistent with some embodiments of the invention, wherein the antenna exhibits an aperture of approximately 2 to 3 degrees.

Consistent with some embodiments of the invention, the system is attachable to an aerial vehicle platform (not shown). The antenna may further include a stabilizing unit (not shown) which takes into account movements of the aerial vehicle platform and adjusts movements of the first and the second actuators, accordingly.

Consistent with some embodiments of the invention, the system further includes a processing unit configured to receive a steering signal indicative of a required steering movement for the antenna and wherein in a case that the required steering movement is above a predefined threshold, the directive beam is steered using the first actuator, wherein in a case that the required steering movement is below a predefined threshold, the directive beam is steered using the second actuator.

Figure 3A:
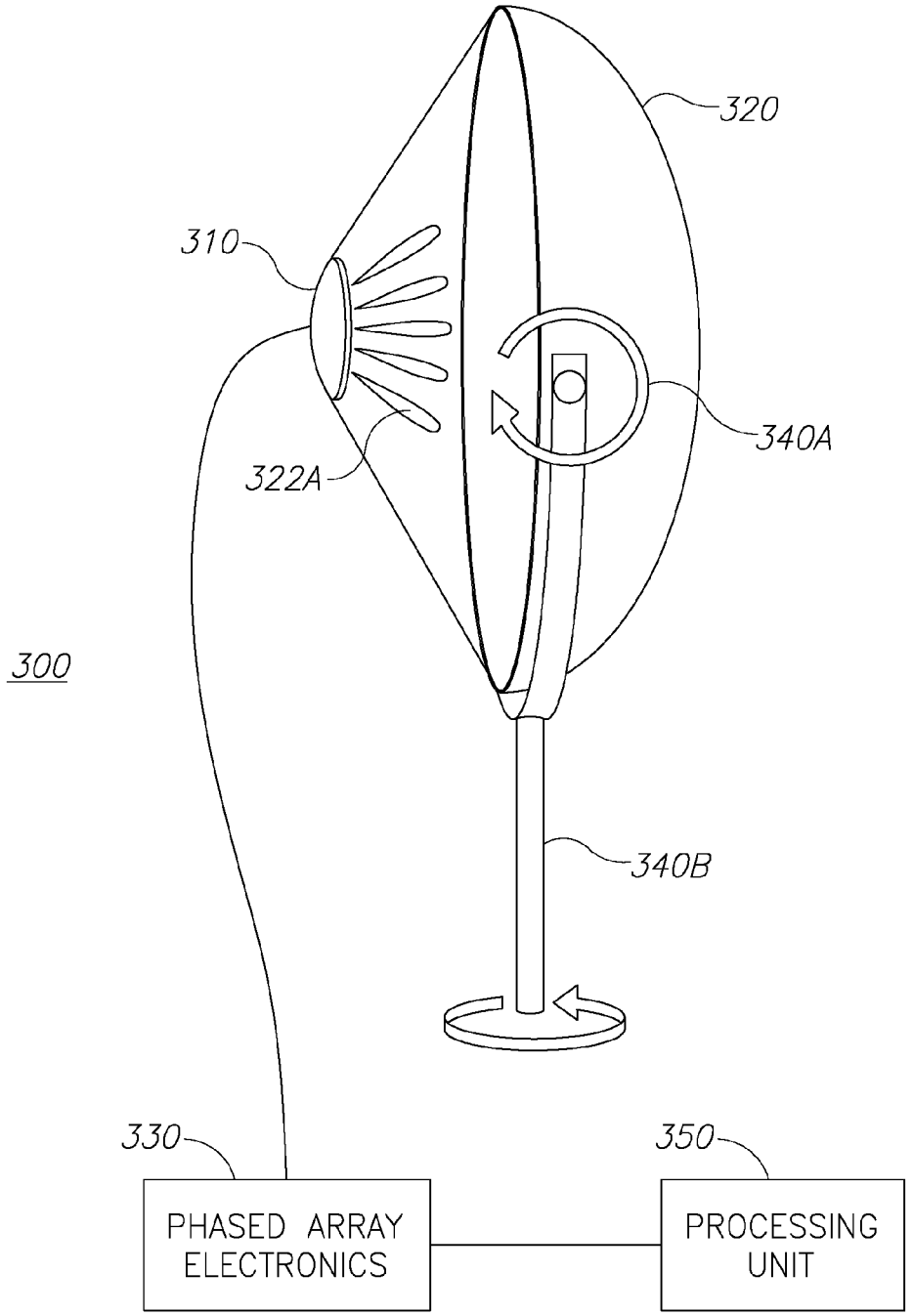
FIGS. 3A and 3B show schematic illustrations of a system according to yet another embodiment of the invention.

FIG. 3A is a schematic illustration of a system according to yet another embodiment of the invention. System 300 includes a phased array antenna 310 operatively associated with corresponding phased array electronics 330. Geometrically, phased array antenna 310 faces a substantially larger reflector 320 which is operatively associated with a set of gimbals 340A-B.

In operation, phased array electronics 330 controls the fast, narrow beam steering while mechanical gimbals 340A-B control the slow and long motions of the beam. The mechanical gimbals 340A-B, because they perform slow motions, require only low mechanical moments and can be of relatively light construction. Polarization control is also in use but not shown for the sake of simplicity. A processing unit 350 may divert and control the operation of either gimbals 340A-B or phased array electronics 330, based on the required steering movement (long-slow or short-fast) at any given point of time.

More specifically, phased array antenna 310 may be shaped as a concave surface. Beams, such as 322A are generated from various active portions which occupy at each point of time only a fraction of the entire surface of phased array antenna 310. Phased array electronics 320 may be configured to generate the beams from different point along the surface of phased array antenna 310, each beam further being directed at a different angle. The location and the angle are set according to the angle of the bean coming from reflector 320. By way of illustration only, in the Ku band, an active portion having a diameter of 2 cm is sufficient for generating a beam having an aperture of approximately 70° wherein the phased array antenna 310 has a diameter of approximately 15 cm.

Figure 3B:
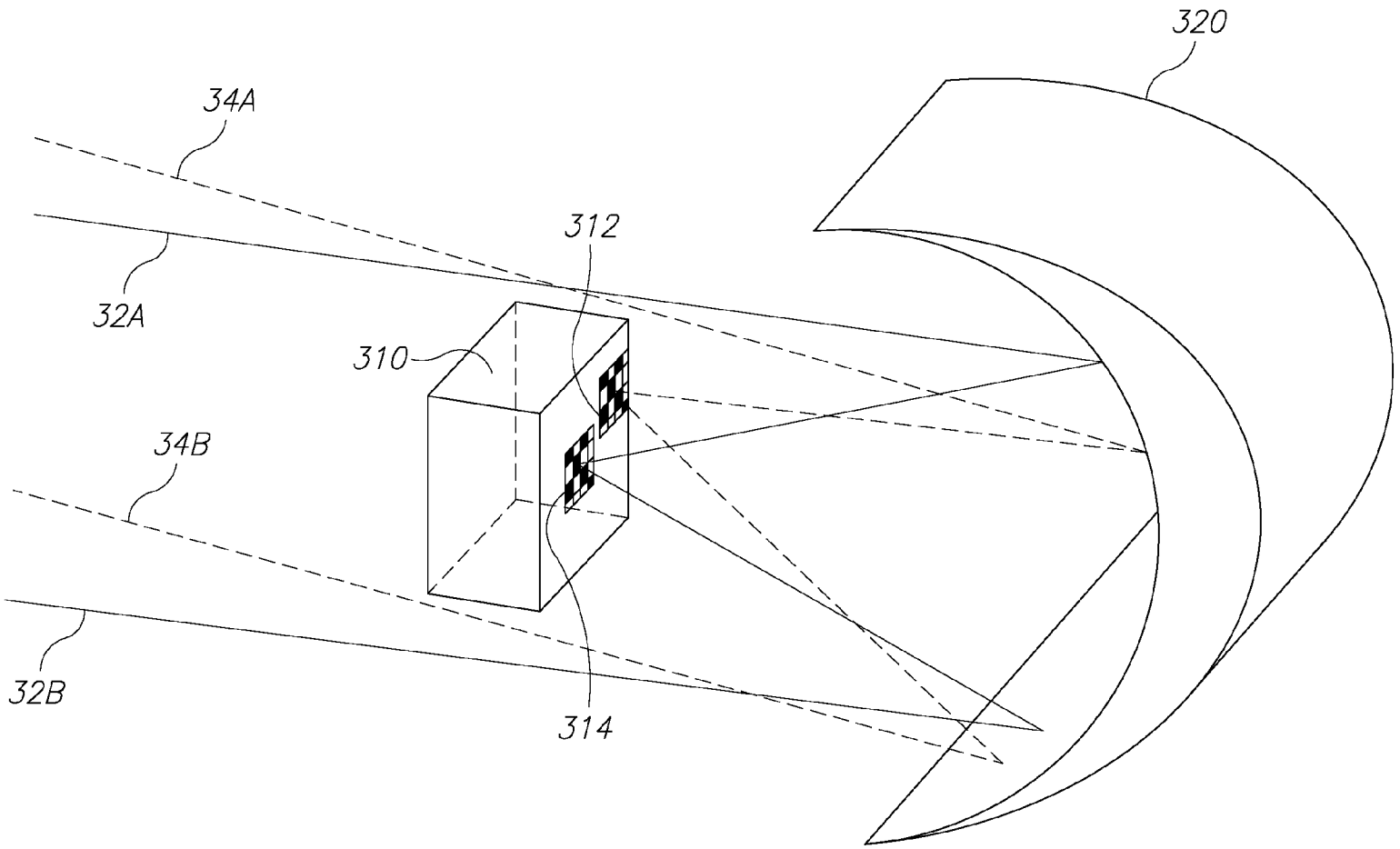

FIG. 3B shows a schematic illustration of a system 300 according to another aspect of the invention. Phased array antenna 310 faces reflector 320. A beam coming from space 34A is being reflected by reflector 320 so that it reaches an active portion 312 on phased array antenna 310 which transmits the beam back to reflector 320 and back to space on beam 34B which is parallel to beam 34A. A similar route applies to beams 32A and 32B with a different active portion 314. The aforementioned operation is made possible by activating different active portions of phased array antenna 310 based on the incoming beams and their respective angles.

Advantageously, system 300 by virtue of using a reflector 320 and a relative small phased array antenna 310 which serves as a feeder provides a higher gain for smaller power and further addresses the aforementioned challenge of steering effectively a narrow beam for both long-slow and short-fast beam steering movements.

Figure 4:
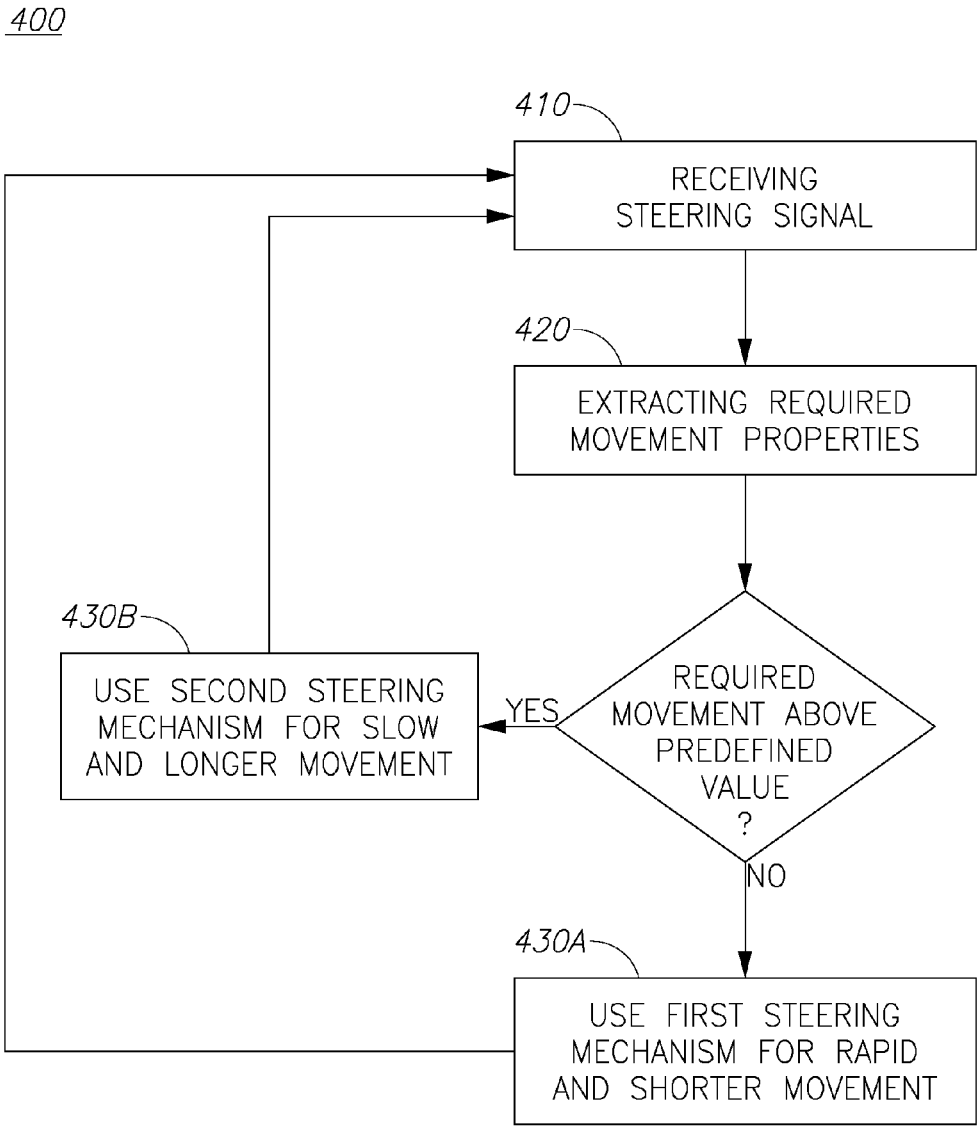
FIG. 4 is a flowchart showing a high level method according to some embodiments of the present invention.

FIG. 4 is a flowchart showing a high level method according to some embodiments of the present invention. It should be understood that method 400 is not limited to any of the aforementioned architectures of either system 100, system 200 or system 300. Specifically, method 400 may be implemented with any architecture that supports two types of steering mechanisms in which one of them is configured for rapid steering of small movements and another steering mechanism which is configured for slower and longer steering movements.

Method 400 starts off with the following stages: receiving a signal indicative of a required steering movement for the antenna 410 and determining if the required movement is above or below a predefined threshold 420. Then, in a case the required movement is above the predefined threshold, using a steering mechanism configured to steer the directive beam in a long and slow movement 430A. In a case the required movement is below the predefined threshold, using a steering mechanism configured to steer the directive beam in a short and rapid movement.

Method 400 may be carried out on board an aerial vehicle platform and may then require a further stage of stabilizing the antenna due to external movements. It is understood that the aforementioned steering movements may have to be adjusted accordingly.

Advantageously, embodiments of the present invention may enable to switch in real-time between the two steering mechanisms to achieve better efficiency of the beam steering process, reduction of vibrations, and further reduction of the power consumption.

In the above description, an embodiment is an example or implementation of the invention. The various appearances of "one embodiment", "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Furthermore, it is to be understood that the invention can be carried out or practiced in various ways and that the invention can be implemented in embodiments other than the ones outlined in the description above.

The invention is not limited to those diagrams or to the corresponding descriptions. For example, flow need not move through each illustrated box or state, or in exactly the same order as illustrated and described.

Meanings of technical and scientific terms used herein are to be commonly understood as by one of ordinary skill in the art to which the invention belongs, unless otherwise defined.

While the invention has been described with respect to a limited number of embodiments, these should not be construed as limitations on the scope of the invention, but rather as exemplifications of some of the preferred embodiments. Other possible variations, modifications, and applications are also within the scope of the invention.

What is claimed is:

1. A method of steering an antenna attached to a moving platform and configured to produce a directive beam, the method comprising:

receiving a signal indicative of a required steering movement for the antenna; and switching in real-time between a first steering mechanism and a second steering mechanism, based on the received signal, wherein the first steering mechanism is configured to apply a steering movement having a first angle over a first period of time and the second steering mechanism is configured to apply a steering movement having a second angle over a second period of time, wherein the first angle is substantially larger than the second angle, and wherein the first period of time is substantially shorter than the second period of time, wherein the first steering mechanism and the second steering mechanism are rotatably independent of each other, wherein the antenna comprises a primary reflector and a secondary reflector facing the primary reflector, and wherein a first steering mechanism is a mechanical actuator coupled to the secondary reflector and configured to mechanically steer the secondary reflector, and wherein a second steering mechanism is a mechanical actuator coupled to the primary reflector and configured to mechanically steer the primary reflector.

2. The method according to claim 1, wherein the antenna is carried by an aerial vehicle and wherein the method further comprising stabilizing the beam unit by taking into account movements of the aerial vehicle and adjusting movements of the first and the second actuators, accordingly.

3. An aerial vehicle comprising:

an antenna configured to produce a directive beam;

a first actuator configured to steer the directive beam over a first angle over a first period of time, by applying a first steering mechanism; and a second actuator configured to steer the directive beam over a second angle over a second period of time, by applying a second steering mechanism, wherein the first and second actuators are switched in real time between the two steering mechanisms based on a signal indicative of a required steering movement for the antenna, wherein the first angle is substantially larger than the second angle, and wherein the first period of time is substantially shorter than the second period of time, wherein the first steering mechanism and the second steering mechanism are rotatably independent of each other, wherein the antenna comprises a primary reflector and a secondary reflector facing the primary reflector, and wherein the first actuator is a mechanical actuator coupled to the secondary reflector and configured to mechanically steer the secondary reflector, and wherein the second actuator is a mechanical actuator coupled to the primary reflector and configured to mechanically steer the primary reflector.

4. The aerial vehicle according to claim 1, wherein the system further comprises a reflector facing the antenna, wherein the reflector is substantially larger than the antenna, wherein the first actuator is a control unit configured to steer the directive beam of the antenna, and wherein the second actuator is a mechanical actuator configured to mechanically steer the reflector.

* * * * *